US006296725B1

(12) United States Patent
Lawson et al.

(10) Patent No.: US 6,296,725 B1
(45) Date of Patent: Oct. 2, 2001

(54) HIGH FREQUENCY RIBBON CABLE FOR TWIST CAPSULE CABLE APPLICATIONS

(75) Inventors: Glenn Lawson, Blacksburg; Tyrone Trenor, Newport; Anthony Lee Bowman, Pembroke, all of VA (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/398,017

(22) Filed: Sep. 17, 1999

Related U.S. Application Data

(60) Provisional application No. 60/102,339, filed on Sep. 29, 1998.

(51) Int. Cl.[7] ..... H01B 13/00

(52) U.S. Cl. ..... 156/50; 156/51; 264/272.11; 174/110 R

(58) Field of Search ..... 156/50, 51, 52, 156/494, 229; 174/110 R, 116, 171.1; 264/272.11; 29/828

(56) References Cited

U.S. PATENT DOCUMENTS

| | | | |
|---|---|---|---|
| 4,000,348 | | 12/1976 | Harlow . |
| 4,149,026 | | 4/1979 | Fritz et al. . |
| 4,281,212 | | 7/1981 | Bogese, II . |
| 4,355,865 | | 10/1982 | Conrad et al. . |
| 4,382,236 | | 5/1983 | Suzuki . |
| 4,423,282 | | 12/1983 | Suzuki et al. . |
| 4,443,657 | | 4/1984 | Hill et al. . |
| 4,468,089 | | 8/1984 | Brorein . |
| 4,490,690 | | 12/1984 | Suzuki . |
| 4,639,693 | | 1/1987 | Suzuki et al. . |
| 4,741,594 | | 5/1988 | Suzuki . |
| 4,924,037 | | 5/1990 | Ainsworth et al. . |
| 4,978,813 | | 12/1990 | Clayton et al. . |
| 5,112,419 | * | 5/1992 | Nakagawa ..... 156/51 |
| 5,189,721 | | 2/1993 | Sayegh et al. . |
| 5,201,903 | | 4/1993 | Corbett, III et al. . |
| 5,245,134 | | 9/1993 | Vana, Jr. et al. . |
| 5,585,979 | * | 12/1996 | Erpelding et al. ..... 360/104 |
| 5,635,677 | | 6/1997 | Wood et al. . |
| 5,917,154 | | 6/1999 | Mortier . |

* cited by examiner

*Primary Examiner*—Michael W. Ball
*Assistant Examiner*—John T. Haran
(74) *Attorney, Agent, or Firm*—Lowe Hauptman Gilman & Berner, LLP

(57) ABSTRACT

Disclosed is a method for surrounding electrical cable, such as coax cable or twinax cable, with an elastomer to form a twist capsule cable. The cables are placed in a fixture and stretched to a desired tautness using rubber bands at opposite ends of each cable without allowing the cables to sag in the fixture. The cables are clamped into yokes at opposite ends of the fixture. An elastomer, such as silicone, is poured into the fixture and allowed to cure. The portion of the cables within the fixture are embedded into the elastomer after the elastomer cures. Additional length of twist capsule cable can be fabricated by performing a similar process on adjoining sections of cable. The elastomer is then coated with a polyxylylene or similar polymer such as Parylene™ to prevent the elastomer from rubbing on itself when coiled and when uncoiling. Advantageously, any number of cables can be embedded in the elastomer to form the twist capsule cable. Also advantageously, the present invention provides excellent attenuation at 1 GHz. Some channels operate between 10 MHz and 80 MHz. The cables are capable of carrying radio, Identify Friend and Foe (IFF), Ethernet and other signals.

21 Claims, 6 Drawing Sheets

HIGH FREQUENCY RIBBON CABLE FOR TWIST CAPSULE CABLE APPLICATIONS

RELATED APPLICATION

The present application claims priority of U.S. Provisional Application Ser. No. 60/102,339, filed Sep. 29, 1998, entitled "High Frequency Ribbon Cable for Polytwist Applications", the disclosure of which is incorporated by reference herein in its entirety.

FIELD OF THE INVENTION

The present invention relates generally to high frequency ribbon cables, and more particularly, to high frequency ribbon cables for twist capsule applications.

BACKGROUND OF THE INVENTION

There are applications in which signals need to be transmitted to a rotating member. Frequently, such signals can be transmitted using electrical slip rings. However, there are applications in which the high frequency of the signal and/or the attenuation of the signal is such that electrical slip rings are not usable. Many times in such applications the rotating member needs to rotate one or two revolutions in a clockwise and/or a counter clockwise direction although rotational travel of up to ten or more revolutions is sometimes required. In such applications, a twist capsule cable is preferred. A conventional twist capsule tape (for use at low frequencies) is constructed of flexible printed circuit material having copper runs laminated between polymer film. These tapes perform in a similar manner to cables of conventional electrical wire, which becomes ineffective as a signal transmission line as frequencies increase.

Sufficient length needs to be provided to allow the twist capsule cable to have enough length so that the twist capsule cable can be coiled, like a clock spring, and have sufficient length to travel to the extreme rotational positions of plus/minus two revolutions.

A need exists in the art to be able to make relatively low volume twist capsule cable for special applications.

SUMMARY OF THE INVENTION

It is, therefore, an object of the invention to provide a method and apparatus for manufacturing high frequency ribbon cable for twist capsule applications in which low volume production runs can be made efficiently and at low cost.

It is another object of the present invention to provide a twist capsule cable which is rugged in operation and economical to manufacture.

These and other objects of the present invention are achieved by providing a method for surrounding electrical cable, such as coax cable or twinax cable, with an elastomer to form a twist capsule cable. The cables are placed in a fixture and stretched to a desired tautness using rubber bands at opposite ends of each cable without allowing the cables to sag in the fixture. The cables are clamped into yokes at opposite ends of the fixture. An elastomer, such as silicone, is poured into the fixture and allowed to cure. The portion of the cables within the fixture are embedded into the elastomer after the elastomer cures. Additional length of twist capsule cable can be fabricated by performing a similar process on adjoining sections of cable. The elastomer is then coated with a polyxylylene or similar polymer such as Parylene™ to prevent the elastomer from rubbing on itself when coiled and when uncoiling. Advantageously, any number of cables can be embedded in the elastomer to form the twist capsule cable. Also advantageously, the present invention provides excellent attenuation at 1 GHz. Some channels operate between 10 MHz and 80 MHz. The cables are capable of carrying radio, Identify Friend and Foe (IFF), Ethernet and other signals.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
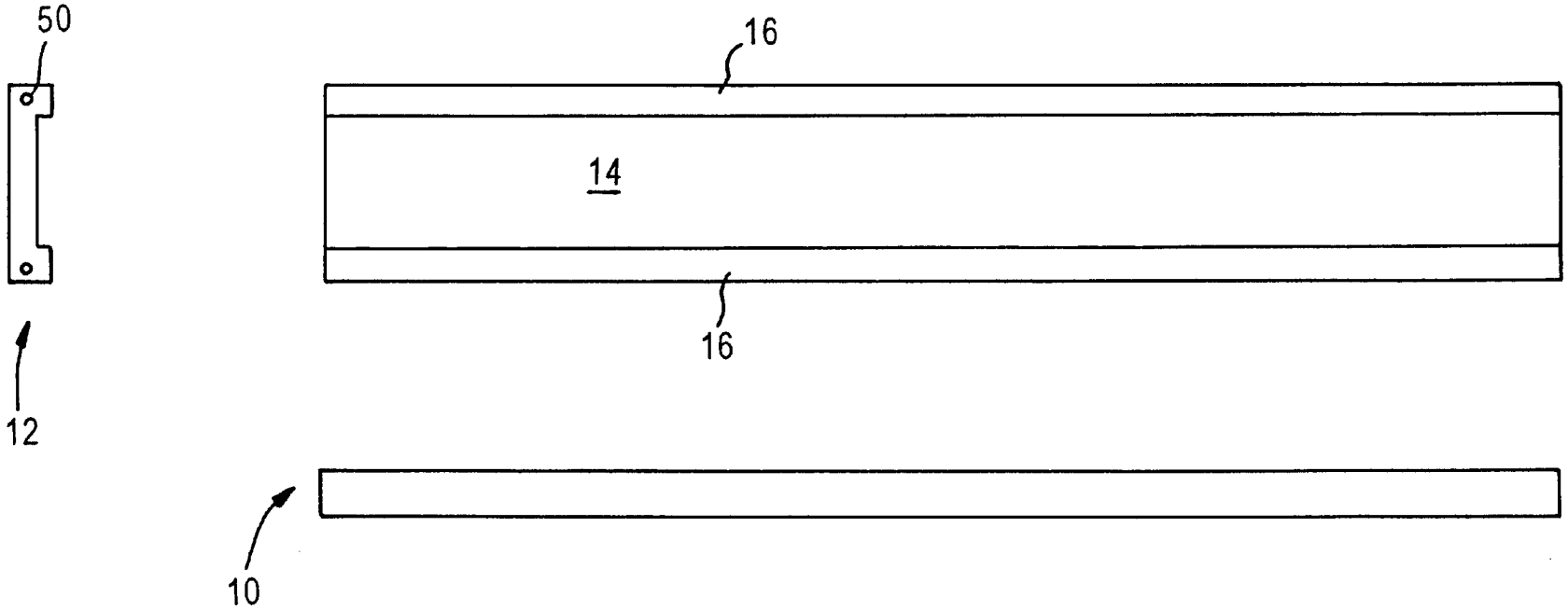
FIG. 1 includes top and side elevational views of an extended aluminum cable potting fixture.

Refer now to FIG. 1 where a portion of an elongated aluminum portion 10 of a cable potting fixture is depicted as used in the present invention. The elongated cable potting fixture includes the elongated portion 10 having longitudinally extending threaded holes 12 on opposite ends thereof and a central channel 14 flanked by a pair of raised channels 16 which extend length wise along the longitudinal direction of the elongated portion 10 on opposite sides thereof. Alternatively, instead of the open mold depicted in FIG. 1, a top plate could be incorporated into the cable potting fixture, having the advantages of better positioning of the cables and forming a more regular geometry, but at added cost and complexity. If higher viscosity encapsulating elastomer and injection pressure is required, then a top plate would become necessary.

Figure 2:
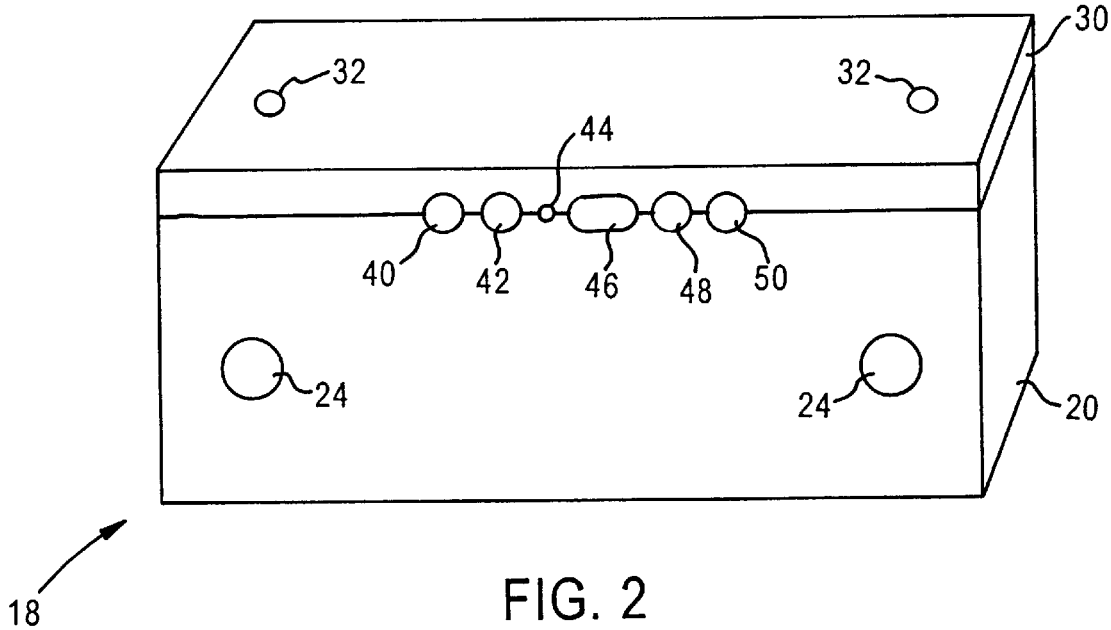
FIG. 2 is a side perspective view of a yoke portion used with the cable potting fixture.

In FIG. 2, a yoke assembly 18 is depicted which includes a lower member 20 and an upper member 30. Two yoke assemblies 18 can be bolted to elongated portion 10 using holes 24 which extend in the longitudinal direction of each lower portion 20 of clamping assembly 18. Lower assembly 20 also includes semicircular recesses 40, 42, 44, 46, 48, 50.

Upper member 30 has corresponding recesses 40, 42, 44, 46, 48, 50 which mate with the recesses in the lower member 20 and form through bores. Upper member 30 is bolted to lower member 20 using holes 32. Corresponding bolt holes (not shown) are located in lower portion 20.

Figure 3:
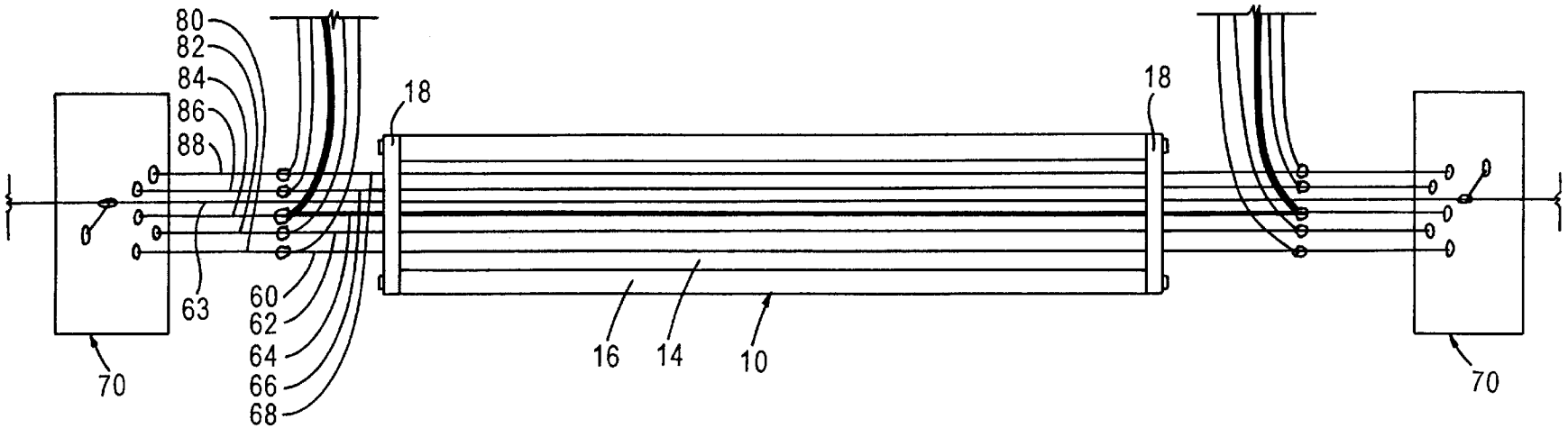
FIG. 3 is a schematic illustration of the cable potting fixture of FIGS. 1 and 2 having coax cable extending between the cable potting fixture and a tensioner fixture.

The method of the present invention is performed as follows. As depicted in FIG. 3, a portion of coax cables 60, 62, 64, 66, 68 and an optical fiber bundle 63 are placed in between a pair of opposed tensioner assemblies 70, each located longitudinally beyond yoke assemblies 18. The coax cables can be, for example Poly-Twist® or other twist capsule cables. Although five cables are described herein, it should be understood that any number of cables can be used in the present invention. The insulating jacket of each cable is preferably removed before each cable is placed in the cable potting fixture. The jacket can be removed if minimum thickness is required, since the elastomer can function as insulation. However, for other applications, where thickness is not a constraint, the coax and twinax jackets would be left on. Alternatively, the cables 60–68 and the optical fiber bundle 63 can each already be embedded in an elastomer.

Cables 60, 62, 64, 66, 68 and the optical fiber bundle 63 are then placed into through bores 40, 42, 46, 48, 50, 44, respectively, of the lower member 20 of each of the yoke assemblies 18. Each of the upper member 30 can then be placed on the lower member 20 but not tightly fastened thereto. Through bores 40–50 are sized according to the outer diameter of each of the coax cables. Tension is applied to each of the cables 60–68 and the optical fiber bundle 63 using tensioner assembly 70. The opposite ends of cables 60–68 and the optical fiber bundle 63 are attached to rubber bands 80, 82, 84, 86, 88 to apply tension to a desired tautness in the longitudinal direction so that cables 60–68 and the optical fiber bundle 63 when located within the elongated fixture 10 and particularly within channel 14, are suspended in such a manner that the cables 60–68 and the optical fiber bundle 63 do not sag within the elongated channel 14. The cables can then be secured by tightening upper member 30 to lower member 20 of yoke assembly 18.

A liquid elastomer can then be poured into the central channel 14 so as to form a section of twist capsule cable according to the present invention.

The raised channels 16 and yoke assemblies 18 form a recess into which the liquid elastomer is poured. The section of cable has a length of preferably approximately 30–36 inches. The elastomer is then allowed to cure. The elastomer is preferably silicone but can also be urethane. After the elastomer cures, the exterior surface of the cured twist capsule cable is then coated with a coating such as Parylene™ which is a hard polymer coating to prevent the elastomer from rubbing on itself and potentially binding when the twist capsule cable is wound upon itself. It is also possible to use a fluorocarbon dry film lubricant, although this is less preferable. It is also possible with proper material selection to have an elastomer with a good balance of surface hardness and lubricity to function well uncoated.

Figure 4:
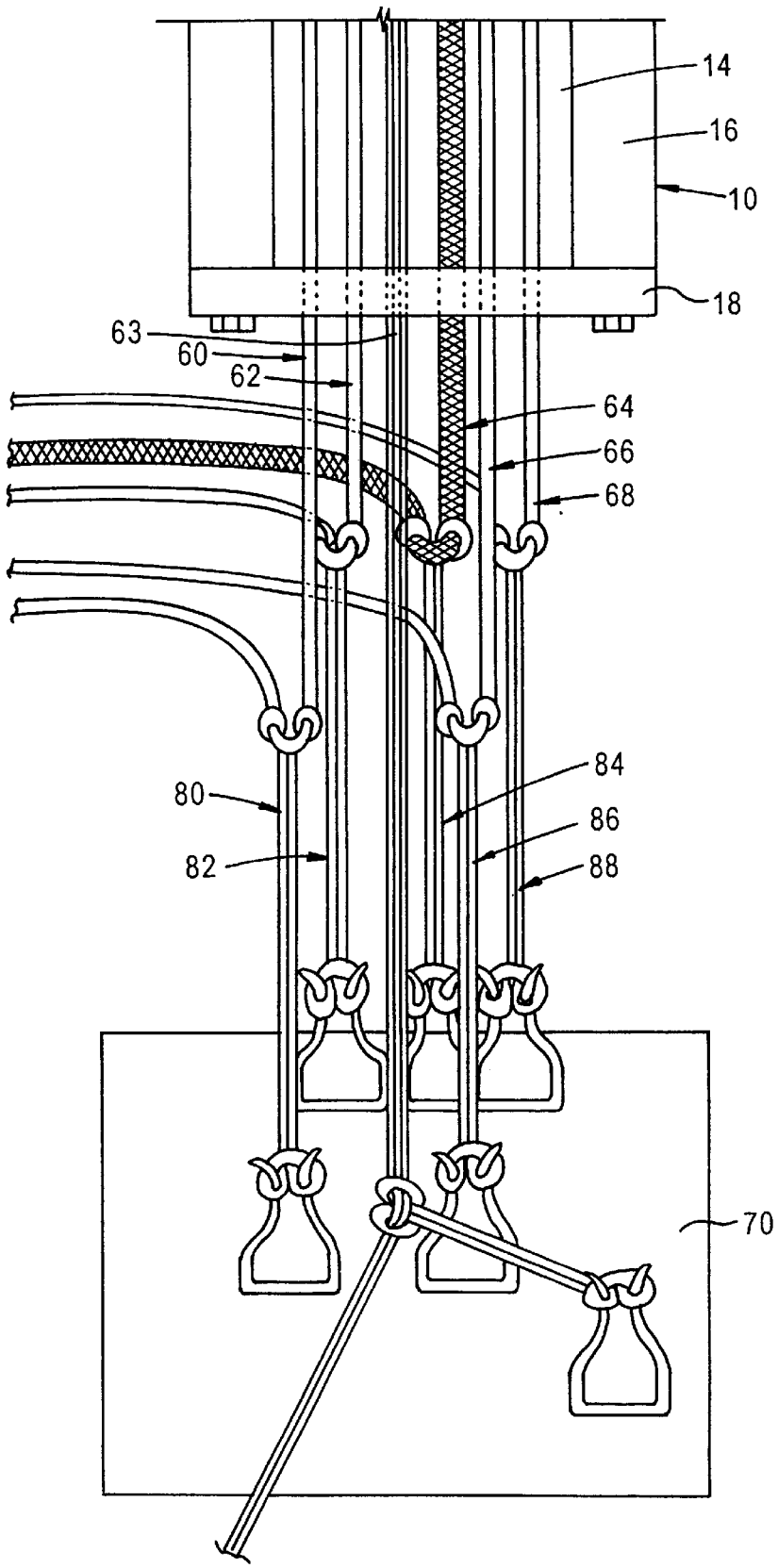
FIG. 4 is a partial top elevational view depicting rubber bands applying tension to coax cables and the tensioner fixture.

The rubber bands and the end of the cables 60–68 are shown in greater detail in FIG. 4. It should be noted that the coax cable is not terminated at the rubber bands, but rather the coax cable is tied together with the rubber band in such a manner that longer twist capsule cables according to the present invention can be fabricated by performing the method two or more times. Longer twist capsule cables are fabricated by performing the previously described method once. Then only a single yoke assembly 18 and tensioner assembly 70 is used. The cured portion of the twist capsule cable is moved approximately the length of the elongated portion 10 and an end portion of the cured portion is placed on one end of the elongated portion 10 where a yoke assembly 18 was previously located. The end portion is then held down with tape or more preferably a clamp. The twist capsule cable is only tensioned on one end as the other end is already embedded in the elastomer. The cables 60–68 and the optical fiber bundle 63 are then tensioned on one end and clamped into yoke assembly 18 and the elastomer is poured into the central channel 14. The embedded portion of twist capsule cable seals the end of the channel 14. The process can be repeated to form longer lengths of embedded twist capsule cable. The Parylene™ coating is only applied after all of the sections of cured elastomer twist capsule cables have been formed. The longer twist capsule cables are continuous without any gaps between sections of elastomer. Alternatively, between sections of twist capsule cables, junctions, splices or transitions can be included.

Figure 5:
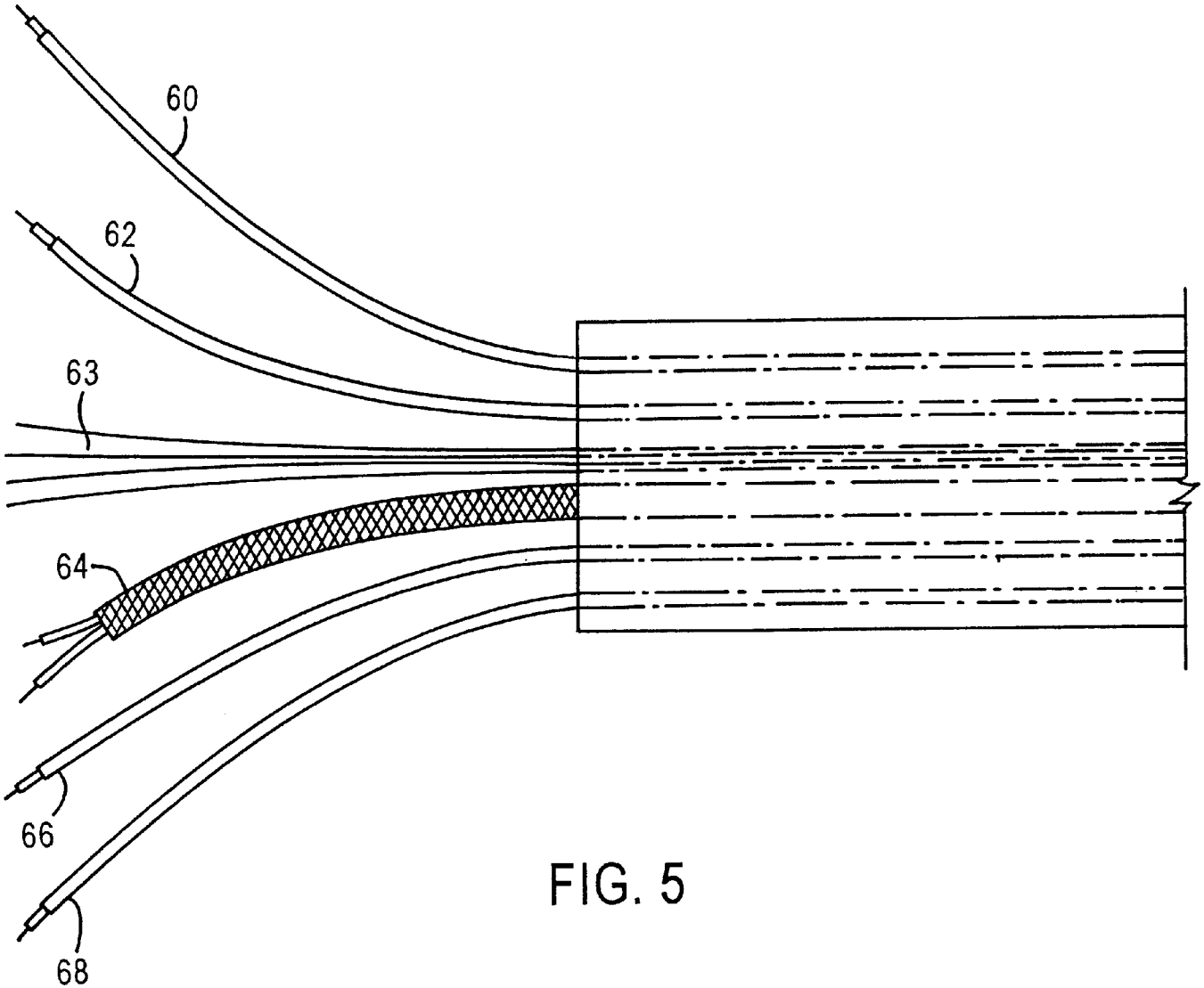
FIG. 5 is a partial side elevational view of a completed twist capsule cable according to the present invention.
Figure 6:
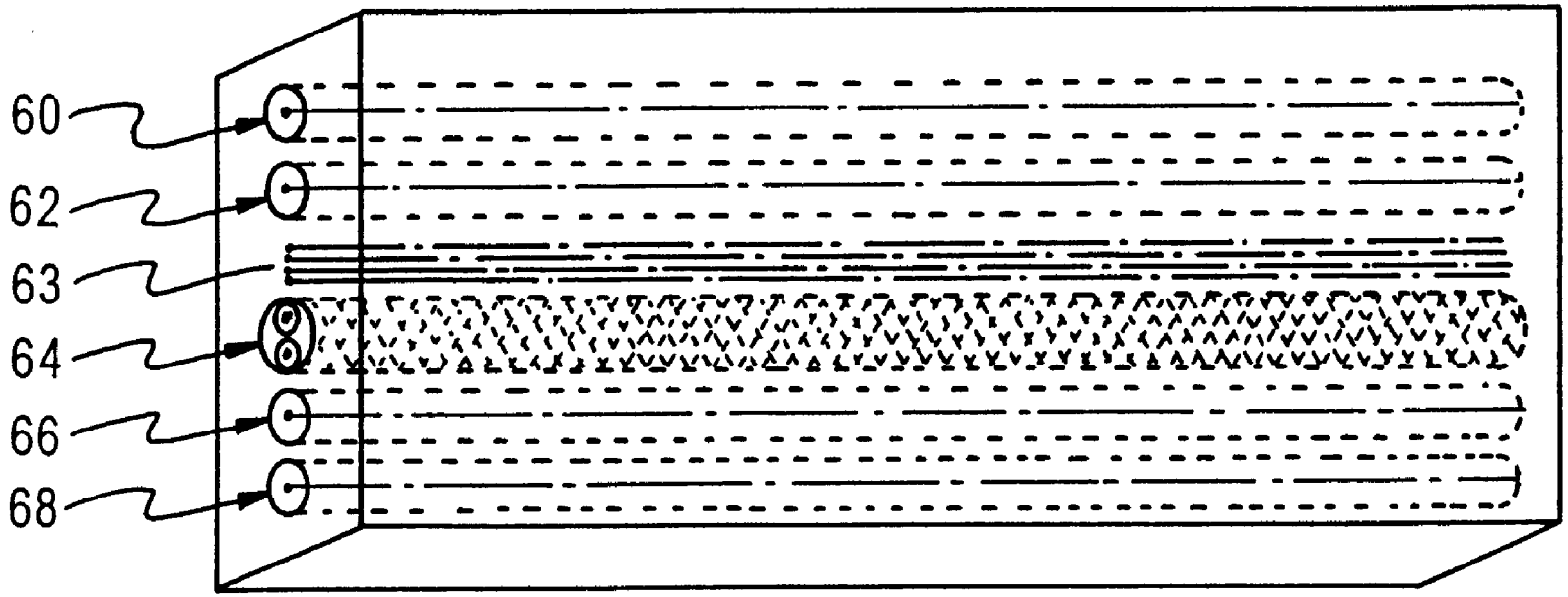
FIG. 6 is a perspective view of the coax cables embedded within the elastomer.

As depicted in FIG. 5, a portion of a twist capsule cable is depicted in which a portion of cables 60–68 and the optical fiber bundle 63 are encased or embedded within the elastomer. The remaining portions of cables 60–68 extend past the embedded portion. FIG. 6 depicts the twist capsule cable in an enlarged view.

For maximum flexibility, it is desirable that the elastomer symmetrically surround each of the coax cables. That is, either top or bottom side of the elastomer surrounding cable should not vary greatly. This can be accomplished by ensuring that the cables 60–68 and the optical fiber bundle 63 are tensioned properly.

It should be understood that lengths of cable, for example, using the fixture 10 depicted in FIG. 1 can be fabricated and additional lengths of cable can then be made by moving the already embedded cable moved essentially the length of cable fixture 10.

It should be understood that the present invention describes a method of manufacturing twist capsule cable which is particularly applicable to low production quantity runs of cable where the cost of extrusion dies and tooling is prohibitive and/or short lead times must be met.

A significant aspect of the invention is a means of allowing fiber optic transmission lines (i.e., fibers) to be incorporated into twist capsule cables for very high frequency signal transmissions with all the advantages of fiber optics (low attenuation, excellent cross-talk isolation and excellent shielding). Instead of a single cable, a bundle of fibers can be used.

Also instead of electrical or fiber optic cables, conventional wires or tubing (to either place fibers in or for fluid channels) or push/pull cables can be embedded in the elastomer.

Transitions, such as T-joints or Y-joints can also be incorporated into the present invention.

Figure 7A:
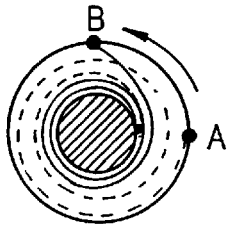
FIGS. 7A and 7B depict the completed twist capsule in a clock spring type application and a roll flex application, respectively.
Figure 7B:
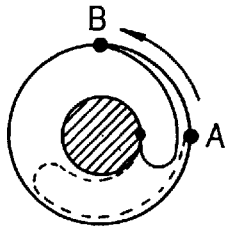

Referring now to FIGS. 7A and 7B, the use of the present invention in a clock spring type application and a roll flex type application drum geometry is depicted. This invention is applicable to both types of twist capsules. The vast majority of twist capsules are of the clock spring type, but there are also roll flex types. Using the clock spring type depicted in FIG. 7A, the coil is wrapped on the outer diameter point A and when rotated in the counterclockwise direction the coil is tightened and wrapped on the inside diameter. Roll flex requires much less cable, but the cable is more severely stressed (limiting life). In either application, more than one twist capsule cable can be used.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein.

What is claimed is:

1. A method of manufacturing a twist capsule cable in a fixture, the twist capsule cable having exposed cable ends extending beyond the fixture, the method comprising the steps of:

placing at least one cable in the fixture;

stretching the at least one cable;

pouring an elastomer into the fixture;

allowing the elastomer to cure thereby embedding a portion of the at least one cable in the cured elastomer such that the exposed cable ends are not embedded in the elastomer; and coating the cured elastomer with a polymer coating.

2. The method of claim 1, wherein the polymer coating is Parylene.

3. The method of claim 1, wherein the elastomer is silicone.

4. The method of claim 1, wherein the at least one cable is one of a coax cable and a twinax cable.

5. The method of claim 1, wherein the stretching step is performed using rubber bands.

6. The method of claim 1, comprising eliminating any slack during said stretching step.

7. The method of claim 1, comprising removing a portion of the cable jacket from the at least one cable.

8. The method of claim 1, wherein the polymer coating is a hard polymer.

9. The method of claim 1, comprising using tensioner assemblies to extend the length of cable placed in the fixture.

10. The method of claim 1, wherein the fixture has a U-shaped cross-section and a pair of end caps, the exposed cable ends extending beyond the end caps.

11. A method of manufacturing a twist capsule cable in a fixture, the twist capsule cable having exposed cable ends extending beyond the fixture, the method comprising the steps of:

stretching at least one cable in a fixture;

embedding a portion of the stretched cable in an elastomer such that the exposed cable ends are not embedded in the elastomer; and coating the elastomer with a polymer coating.

12. The method of claim 11, wherein the polymer coating is Parylene.

13. The method of claim 11, wherein the elastomer is silicone.

14. The method of claim 11, wherein the at least one cable is one of a coax cable and a twinax cable.

15. The method of claim 11, wherein the stretching step is performed using rubber bands.

16. The method of claim 11, comprising eliminating any slack during said stretching step.

17. The method of claim 11, comprising removing a portion of the cable jacket from the at least one cable.

18. The method of claim 11, wherein the polymer coating is a hard polymer.

19. The method of claim 11, wherein said embedding step includes pouring a liquid elastomer into the fixture and allowing the liquid elastomer to cure, thereby embedding the at least one cable in the elastomer.

20. A twist capsule cable product, the twist cable having exposed cable ends, the twist cable product manufactured using the steps of:

placing at least one cable in a fixture;

stretching the at least one cable;

pouring an elastomer into the fixture;

allowing the elastomer to cure thereby embedding a portion of the at least one cable in the cured elastomer such that the exposed cable ends are not embedded in the elastomer; and coating the cured elastomer with a polymer coating.

21. A twist capsule cable product the twist cable having exposed ends, the twist cable product manufactured using the steps of:

stretching at least one cable in a fixture;

embedding a portion of the stretched cable in an elastomer such that the exposed cable ends are not embedded in the elastomer; and coating the elastomer with a polymer coating.

* * * * *